US005438764A

United States Patent [19]

Reppas et al.

[11] Patent Number: 5,438,764

[45] Date of Patent: Aug. 8, 1995

[54] FOOT DRYER

[76] Inventors: George S. Reppas, 1030 San Raymundo Rd., Hillsborough, Calif. 94010; Robert G. Reppas, 48 Highland Ave., Apt. 2, Cambridge, Mass. 02139; Charles B. Reppas, 502-225 Place South East, Bothell, Wash. 98021; Katherine A. Reppas, 511 Via Collinas, West Lake Village, Calif. 91362

[21] Appl. No.: 186,651

[22] Filed: Jan. 25, 1994

[51] Int. Cl.[6] ..... A61M 35/00

[52] U.S. Cl. ..... 34/343; 222/146.5

[58] Field of Search ..... 34/212, 343, 415, 201, 34/202; 222/195, 161, 146.5

[56] References Cited

U.S. PATENT DOCUMENTS

| | | | |
|---|---|---|---|
| 1,413,862 | 4/1922 | MacDonald . | |
| 1,658,489 | 2/1928 | Lindstrom . | |
| 2,247,483 | 7/1941 | Eastman | 12/1 |
| 3,711,958 | 1/1973 | Lepage | 34/88 |
| 3,986,643 | 10/1976 | Chutter | 222/195 |
| 4,878,602 | 11/1989 | Weigelt | 222/161 |
| 5,003,705 | 4/1991 | Lee | 34/54 |
| 5,007,182 | 4/1991 | Fishman et al. | 34/90 |
| 5,130,551 | 7/1992 | Nafziger et al. | 250/492.1 |
| 5,157,850 | 10/1992 | Terng-Shuh | 34/202 |

*Primary Examiner*—Henry A. Bennet
*Assistant Examiner*—William C. Doerrler
*Attorney, Agent, or Firm*—Harness, Dickey & Pierce

[57] ABSTRACT

A foot dryer for drying toes on a foot of an individual has a blower which directs air through apertures in a top panel of a housing. A switch is positioned on the top panel adjacent to the apertures such that when the switch is activated by the individual using the ball of their foot, the toes of the individual are located directly above the apertures. Both a heating device and/or a powder dispenser may be incorporated between the blower and the apertures to either warm the air and/or dispense powder to the toes respectively. An optional timing mechanism may be incorporated to allow the powder to be dispensed automatically after the toes of the foot have had a sufficient time to dry. The air time for drying and/or powder could be set by the user or it could be set to a normal setting.

15 Claims, 2 Drawing Sheets

FOOT DRYER

FIELD OF THE INVENTION

The present invention relates to a portable dryer. More particularly, the present invention relates to a portable foot dryer for drying a person's feet, especially the region of the foot between the person's toes.

BACKGROUND OF THE INVENTION

Tinea pedis (fungus of the foot), what is commonly called athlete's foot, is a reoccurring problem among numerous individuals. Athlete's foot is highly contagious and is easily transmitted between individuals via personal items such as clothes, towels and sports equipment which are used by more than one individual. In addition, athlete's foot can be easily caught by simply walking barefoot in public showers, baths or damp places. Fungus, in general, thrive in a warm, dark and damp environment. An individual's foot, especially the area between the toes, creates a perfect environment for the spread of fungus. An individual's foot has extensive sweat glands which dampen the shoes and socks of the individual creating the perfect environment for the growth or spread of fungus.

In order to prevent and/or cure athlete's foot, numerous products are available. These include sprays, powders, ointments and other types of treatments. One of the most effective preventive methods and/or treatments for athlete's foot is to insure that the foot in general and the area between the toes in particular is kept dry in order to prevent the growth and spread of the fungus. When the dryness of the foot is combined with the application of an antiseptic treatment such as foot powder, effective prevention and/or treatment of athlete's foot is further achieved.

SUMMARY OF THE INVENTION

The present invention provides the art with a unique foot drying apparatus which is especially effective for drying the area of the foot located between the toes. After completion of the drying operation, the individual has the option of automatically applying a measured amount of foot powder to the foot and especially the area located between the toes.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
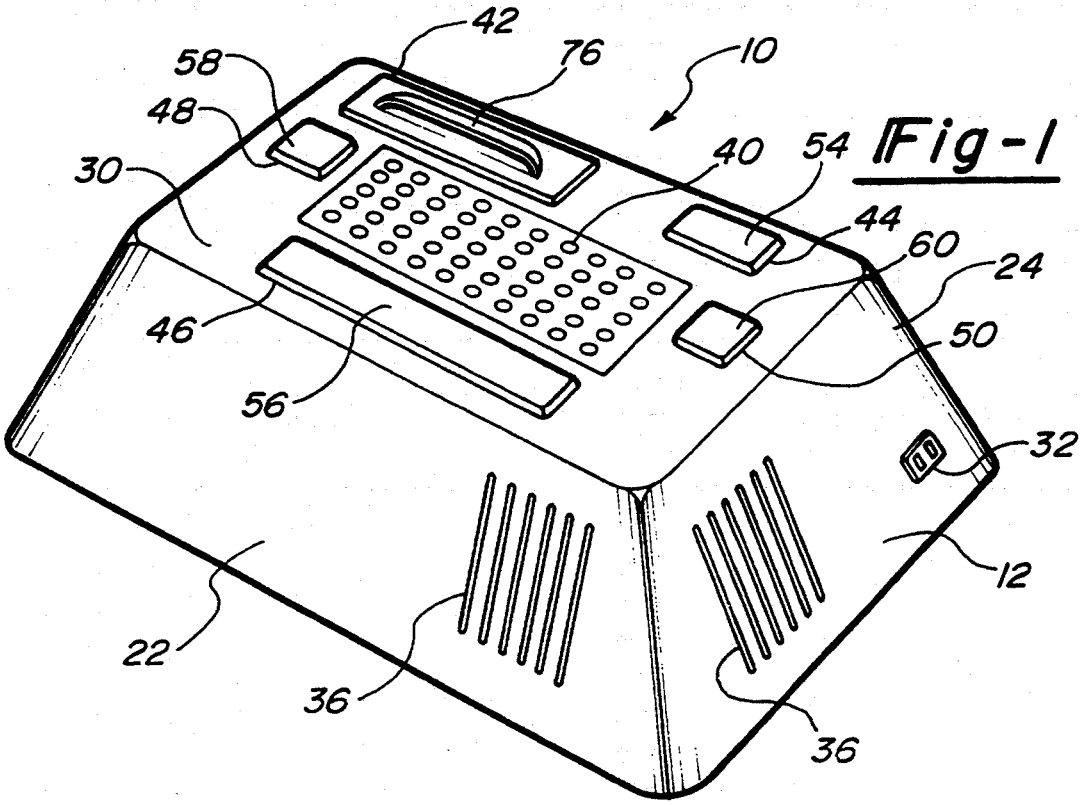
FIG. 1 illustrates a top plan view of the foot dryer according to the present invention.
Figure 2:
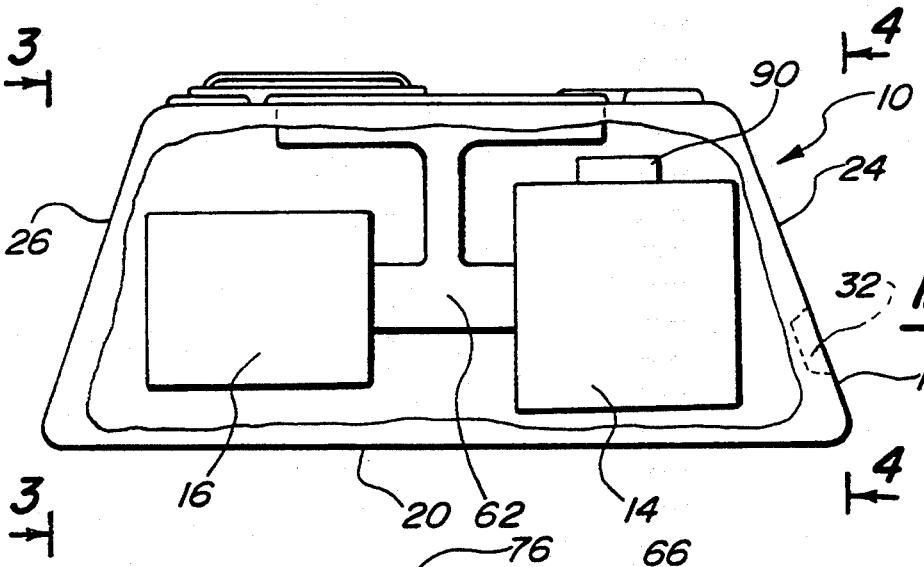
FIG. 2 illustrates a front elevations view of the foot dryer shown in FIG. 1 with a portion of the front housing panel removed.
Figure 3:
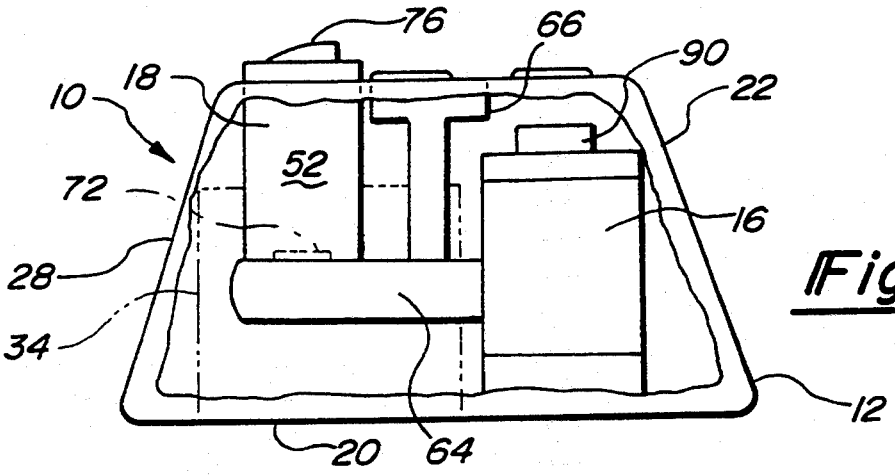
FIG. 3 illustrates a side elevational view in the direction of arrows 3—3 of FIG. 2 with a portion of the side housing panel removed.

Referring now to the drawings in which like reference numerals designate like or corresponding parts throughout the several views, there is shown in FIGS. 1 through 3 a foot drying apparatus in accordance with the present invention which is designated generally by the reference numeral 10. Foot drying apparatus 10 comprises a housing 12, an air blower 14, a heating device 16 and an optional powder dispenser 18.

Figure 4:
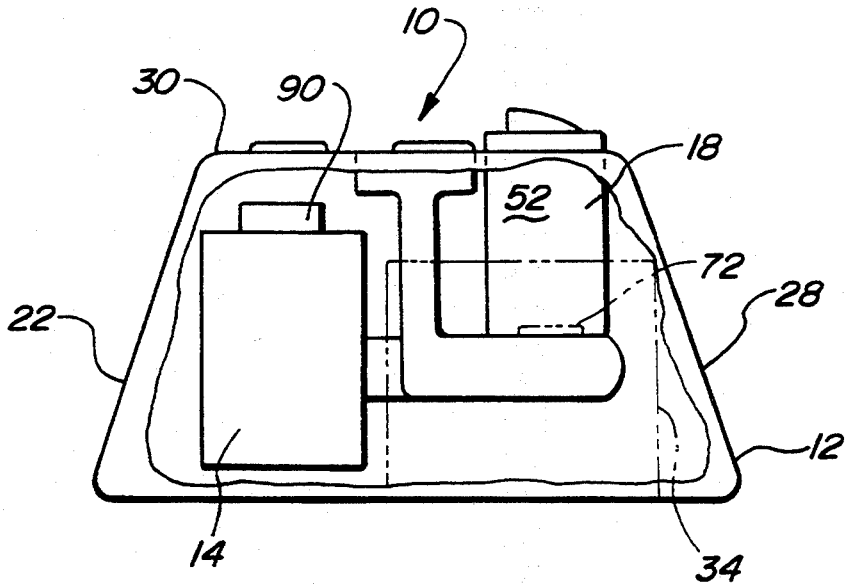
FIG. 4 illustrates a side elevational view in the direction of arrows 4-4 of FIG. 2 with a portion of the side housing panel removed.

Housing 12 is a generally trapezoidal shaped box having a bottom panel 20, four side panels, 22, 24, 26 and 28 and a top panel 30. Bottom panel 20 provides support for the internal components of apparatus 10 and acts as a base for supporting the weight of the individual using the apparatus. Side panels 22, 24, 26 and 28 extend angularly upward from bottom panel 20 to provide support for top panel 30 and form the generally trapezoidal shape of housing 12. Although housing 12 is illustrated for exemplary purposes as being generally trapezoidal in shape, it is to be understood that other shapes can be used for housing 12. An electrical connector 32 extends through side panel 24 in order to provide access to power to operate apparatus 10 and/or provide charging for a battery pack 34 (shown in phantom in FIGS. 3 and 4) disposed within housing 12. Side panels 22 and 24 each include a plurality of louvers 36 for providing outside air to air blower 14 as will be described later herein.

Top panel 30 has a plurality of apertures 40 extending through it for providing air blown by air blower 14 to exit housing 12 and be directed against the individual's foot. Top panel 30 also includes five additional apertures 42, 44, 46, 48 and 50 which provide for access to the features provided for by foot drying apparatus 10. Aperture 42 provides access to a storage compartment 52 which is a component of powder dispenser 18. Aperture 44 provides access to a switch 54 which is used to actuate optional powder dispenser 18. Aperture 46 provides access to a switch 56 which activates air blower 14. Finally, apertures 48 and 50 provide access to a pair of switches 58 and 60. Switch 58 activates heating device 16 when depressed and switch 60 deactivates heating device 16 when depressed.

Air blower 14 is a conventional electric blower disposed within housing 12. Air blower 14 receives room temperature air through the plurality of louvers 36 and blows air out or through heating device 16 through a conduit 62. Air blower 14 communicates electrically with switch 56 such that the on/off control for air blower 4 is controllable by the individual using his foot to activate air blower 14 by using switch 56. Air blowing devices suitable for air blower 14 are well known in the art and will therefore not be discussed further herein.

Heating device 16 is a conventional electrical heating device disposed within housing 12. Heating device 16 receives the room temperature air blown by air blower 16 from conduit 62 and delivers air through the plurality of apertures 40 via conduit 64 and manifold 66. Heating device 16 communicates electrically with switches 58 and 60 such that the on/off control for heating device 16 is controllable by the individual using his foot to activate heating device 16 by using switch 58 and deactivate heating device 16 by using switch 60. Heating device 16 also communicates electrically with air blower 14 such that heating device 16 does not come on without the activation of air blower 14 for desired temperature and for safety reasons. When heating device 16 is activated, air travelling from conduit 62 to conduit 64 through heating device 16 is heated in order to more effectively dry the individual's foot. Heating devices suitable for heating device 16 are well known in the art and therefore will not be discussed further herein.

Powder dispenser 18 is also disposed within housing 12 and includes powder storage compartment 52 and a metered dispensing mechanism 72 disposed within compartment 52. Compartment 52 is a generally hollow box-like structure defining an internal cavity within which foot powder is stored. Dispensing mechanism 72 is located within this internal cavity and is in communication with both the internal cavity of compartment 52 and the interior of conduit 64. A cap 76 maintains an air tight seal with compartment 52 and insures that foot powder will not be blown backwards through compartment 52 while providing access to cavity 74 to replenish the supply of foot powder.

Dispensing mechanism 72 functions to deliver a metered amount of foot powder from the internal cavity of compartment 52 to the interior of conduit 64 upon command. Dispensing mechanism 72 communicates either electrically or mechanically with switch 54 to dispense the metered amount of foot powder from the internal cavity of compartment 52 to the interior of conduit 64 upon activation of switch 54 by the individual using his foot or automatically using a timing mechanism as will be described later herein. Both mechanical and electrical metered dispensing devices of the type applicable to dispensing mechanism 72 are well known in the art and will therefore not be discussed further herein.

Foot drying apparatus 10 can be operated by connecting apparatus 10 to household electrical current using electrical connector 32 and the appropriate electrical cord. Air blower 14 is wired through switch 56; heating device 16 is wired through switches 58 and 60 and air blower 14; and powder dispenser 18, if an electrical dispensing mechanism 72 is used, is wired through switch 54. It may be desirable, for providing portability, for foot drying apparatus 10 to operate on battery power. If this is desired, foot drying apparatus 10 can include battery pack 34 shown in phantom in FIGS. 3 and 4. Battery pack 34 may include only electrical storage cells which can be charged by attaching the output of a battery charger to electrical connector 32 or battery pack 34 may incorporate both the storage cells and the battery charger in which case connector 32 would be attached to household current.

The operation of foot drying apparatus 10 begins with both switches 54 and 56 being in the off position. Once an individual has hand dried their feet using a towel or similar drying cloth, the individual places the forward portion of their foot on top panel 30 with their toes directly over the plurality of apertures 40. If warmed air is desired, the individual activates heating device 16 by pressing down on switch 58. If room temperature air is desired, the individual deactivates heating device 16 by pressing down on switch 60. Air blower 14 is activated by the individual by placing their weight on the ball of their foot and having the ball of their foot push down on switch 56. The act of placing the individual's weight on the ball of the foot operates to spread the toes of the individual. This also allows the individual to flex their toes in an upward direction which then has a further tendency to spread their toes and open the area between their toes. Air blown by air blower 14, at room temperature if heating device 16 is not activated or at heated temperatures if heating device 16 is activated, is pulled through louvers 36 and directed through conduit 62, through heating device 16, through conduit 64, through manifold 66, through the plurality of apertures 40 and in between the individual's toes to effect a complete drying of the individual's foot especially the area between the toes.

When the drying operation is complete, the individual releases switch 56 by removing their weight from the ball of their foot. The individual then activates switch 54 which either electrically or mechanically causes dispensing mechanism 72 of powder dispenser 18 to transfer a metered amount of foot powder from the internal cavity of compartment 52 into the interior of conduit 64. The individual then again places their weight on the ball of their foot to actuate switch 56 and cause air blower 14 to operate and blow air along with the dispensed foot powder through the plurality of apertures 40 and in between the individual's toes. Upon completion of the powdering process, the individual removes his foot from foot drying apparatus 10. Either one or both feet of the individual may be dried and powdered if desired.

A timing mechanism 90 can also be incorporated into foot drying apparatus 10 that allows sufficient drying time before the powder is automatically dispensed by dispenser 18. With timing mechanism 90 added, timing mechanism 90 can be manually set or timing mechanism 90 can be preset to a normal drying time with the powder being automatically dispensed into conduit 64 by dispenser 18 at the end of the preset time. Timing mechanism 90, when incorporated, will electrically communicate with air blower 14 and option powder dispenser 18 in order to operate foot drying apparatus 10 in an automatic mode.

While the above detailed description describes the preferred embodiment of the present invention, it should be understood that the present invention is susceptible to modification, variation and alteration without deviating from the scope and fair meaning of the subjoined claims.

What is claimed is:

1. An apparatus for drying toes on a foot of an individual, said apparatus comprising:

a housing having a top panel and defining an internal cavity, said top panel defining a plurality of apertures extending through said top panel;

a blower disposed within said internal cavity;

a powder dispenser disposed between said blower and said plurality of apertures; and a first switching member for activating said blower, said blower operative to blow air through said plurality of apertures in said top panel of said housing, said first switching member disposed on a portion of said top panel of said housing adjacent said plurality of apertures such that said first switching member is activated by said individual positioning the ball of said foot on said first switching member and placing weight on the ball of said foot so as to position said toes of said individual directly above said plurality of apertures, wherein activation of said first switching member by placing the weight on the ball of said foot is operative to spread and open the area between said toes to allow said individual to flex said toes in and upward direction to effect the drying of said toes.

2. The apparatus according to claim 1 further comprising a heating device disposed within said housing between said blower and said plurality of apertures, said heating device operable to warm said air blown by said blower.

3. The apparatus according to claim 2 further comprising a second switching member disposed on said top panel for activating said heating device.

4. The apparatus according to claim 3 further comprising a third switching member disposed on said top panel for deactivating said heating device.

5. The apparatus according to claim 2 further comprising a second switching member disposed on said top panel for selectively activating said powder dispenser.

6. The apparatus according to claim 1 further comprising a second switching member disposed on said top panel for selectively activating said powder dispenser.

7. The apparatus according to claim 1 further including a timing mechanism for operating said blower a specified length of time prior to the activation of said powder dispenser.

8. An apparatus for drying toes on a foot of an individual, said apparatus comprising:

a housing having a top panel and defining an internal cavity, said top panel defining a plurality of apertures extending through said top panel;

a heating device disposed within said housing between said blower and said plurality of apertures, said heating device operable to warm air blown by said blower;

a powder dispenser disposed between said heating device and said plurality or apertures, said powder dispenser operable to enable powder to be blown through the plurality or apertures by said blower; and a first switching member for activating said blower, said blower operative to blow air through said plurality of apertures in said top panel of said housing, said first switching member disposed on a portion of said top panel of said housing adjacent said plurality of apertures such that said first switching member is activated by said individual positioning the ball of said foot on said first switching member and placing weight on the ball of said foot so as to position said toes of said individual directly above said plurality of apertures to effect the drying of said toes.

9. The apparatus according to claim 8 further comprising a second switching member disposed on said top panel for activating said heating device.

10. The apparatus according to claim 9 further comprising a third switching member disposed on said top panel for deactivating said heating device.

11. The apparatus according to claim 9 further comprising a second switching member disposed on said top panel for selectively activating said powder dispenser.

12. The apparatus according to claim 8 further including a timing mechanism for operating said blower a specified length of time prior to the activation of said powder dispenser.

13. An apparatus for drying toes on a foot of an individual, said apparatus comprising:

a housing having a top panel and defining an internal cavity, said top panel defining a plurality of apertures extending through said top panel;

a blower disposed within said internal cavity;

a heating device disposed within said housing between said blower and said plurality of apertures, said heating device operable to warm air blown by said blower;

a first switching member disposed on a portion of said top panel for activating said heating device;

a powder dispenser disposed between said heating device and said plurality of apertures, said powder dispenser operable to enable powder to be blown through the plurality of apertures by said blower;

a second switching member disposed on a portion of said top panel for selectively activating said powder dispenser;

a third switching member for activating said blower, said blower operative to blow air through said plurality of apertures in said top panel of said housing, said third switching member disposed on a portion of said top panel of said housing adjacent said plurality of apertures such that said third switching member is activated by said individual positioning the ball of said foot on said third switching member and placing weight on the ball of said foot so as to position said toes of said individual directly above said plurality of apertures to effect the drying of said toes.

14. The apparatus according to claim 13 further comprising a fourth switching member disposed on a portion of said top panel for deactivating said heating device.

15. The apparatus according to claim 13 further including a timing mechanism for operating said blower a specified length of time prior to the activation of said powder dispenser.

* * * * *

UNITED STATES PATENT AND TRADEMARK OFFICE

CERTIFICATE OF CORRECTION

PATENT NO. : 5,438,764

DATED : August 8, 1995

INVENTOR(S) : George S. Reppas; Robert G. Reppas; Charles B. Reppas; Katherine A. Reppas It is certified that error appears in the above-indentified patent and that said Letters Patent is hereby corrected as shown below:

Column 1, line 60, "elevations" should be — elevational —.

Column 2, line 52, "4" should be — 14 —.

Column 2, line 60, "16" should be — 14 —.

Column 5, after line 26, insert as a new paragraph — a blower disposed within said internal cavity; —.

Column 6, line 4, "9" should be — 8 —.

Signed and Sealed this

Thirtieth Day of April, 1996

*Attest:*

*Attesting Officer*

BRUCE LEHMAN

*Commissioner of Patents and Trademarks*